United States Patent [19]

Lin

[11] Patent Number: 4,813,520

[45] Date of Patent: Mar. 21, 1989

[54] EXTERNALLY AND DETACHABLY FRAMED COLLAPSIBLE BAGGAGE

[76] Inventor: Tri-Ping Lin, 146 I An Rd., Chungho, Taiwan

[21] Appl. No.: 82,359

[22] Filed: Aug. 6, 1987

[51] Int. Cl.[4] ..... A45C 7/00

[52] U.S. Cl. ..... 190/107; 190/18 A; 190/116; 220/9.3

[58] Field of Search ..... 190/8, 18 A, 24, 103, 190/107, 122, 127, 21, 116; 150/49, 51; 248/99

[56] References Cited

U.S. PATENT DOCUMENTS

| | | | |
|---|---|---|---|
| 342,563 | 5/1943 | Hamon . | |
| 1,111,428 | 9/1914 | Aronoff | 150/49 |
| 1,155,475 | 10/1915 | Fay | 150/49 |
| 1,329,194 | 1/1920 | Makruzin | 190/122 |
| 2,512,101 | 6/1950 | Hack | 150/49 |
| 2,571,442 | 10/1951 | Griffith | 150/49 X |
| 2,710,084 | 6/1955 | Braverman . | |
| 3,165,178 | 1/1965 | Pelavin et al. . | |
| 3,447,648 | 6/1969 | Schwennicke . | |

FOREIGN PATENT DOCUMENTS

| | | | |
|---|---|---|---|
| 126211 | 12/1947 | Australia | 190/103 |
| 433661 | 11/1911 | France | 190/107 |
| 500 | 10/1907 | United Kingdom | 190/127 |
| 580515 | 9/1946 | United Kingdom | 190/103 |

*Primary Examiner*—William Price

*Attorney, Agent, or Firm*—Wenderoth, Lind & Ponack

[57] ABSTRACT

A collapsible piece of baggage, comprising internally a flexible or pliable bag enclosure and externally a detachable frame to outline the bag-defining formation and to hold the flexible or pliable bag enclosure, is constructed and well arranged so that it may be readily reduced in size for storage or other purposes and so that it may be easily and quickly set up into operative condition, ready for use.

3 Claims, 3 Drawing Sheets

EXTERNALLY AND DETACHABLY FRAMED COLLAPSIBLE BAGGAGE

BACKGROUND OF THE INVENTION

Conventional baggage or the like available in the market can generally be grouped into three forms, rigid envelop, pliable enclosure and semi-rigid form with rigid shifter pad attached, wherein the piece of baggage of the pliable enclosure type does not have a firmly bag-defining formation to protect its contents from squeezing or breaking and is generally used for packing quilt or clothing; the rigid and semi-rigid form can not be reduced in size when not in use, which will increase the cost of manufacturing, transportation and storage.

In view of the above-mentioned disadvantages of conventional rigid and semi-rigid form of baggage and the like, the present invention has been created by the present inventor to overcome the problem in question.

The "Folding trunk and the like" of U.S. Pat. Nos. 342,563 of J. Hamon, the "Traveling Bags" of U.S. Pat. No. 2,710,084 of I. L. Braverman, the "Light-weight Luggage Case with Reinforcing X-frame" of U.S. Pat. No. 3,165,178 of J. Y. Pelavin et al., and the "Variable Volume Suitcase" of U.S. Pat. No. 3,447,648 of F. Schwennicke are all of collapsible form and can be reduced in size when not in use. These patents have the same collapsible purpose yet of a different method or different collapsible structure and they have the same provision of a collapsible form with a frame being concealed from view externally of the bag by a unitary bag enclosure, which frame can be readily collapsed and set up within the bag enclosure for collapsing the bag and for holding the bag; however, they are not detachable.

In comparision with the cited patents, the detachable or collapsible baggage of the present invention proves more creative in structure and more practical in use.

SUMMARY OF THE INVENTION

One object of the present invention is the provision of a detachable or collapsible piece of baggage with an external frame to protect the bag enclosure within the frame-outlined bag defining formation.

Another object of the invention is to provide a detachable or collapsible baggage with frame which is of simple construction and which can be readily detached or collapsed and set up for holding the bag enclosure within it in its normal bag-defining formation.

Another object of the invention is the provision of a detachable or collapsible baggage with a flexible or pliable bag enclosure which has external sleeves one each available along the four peripheral edges of the two large opposite faces of the bag enclosure for the frame to insert into and to set up the bag-defining formation and to hold the bag enclosure.

Another object of the invention is generally to provide a detachable or collapsible baggage which is simple and inexpensive to manufacture and which is convenient in use and which when not in use can be reduced in size and placed within a small place for storage.

A yet further object of the invention is to provide a detachable or collapsible piece of baggage with a pivotally secured carrying handle, an extension handle, and two pairs of rolling wheels for the convenience of traveling.

DETAILED DESCRIPTION OF THE PREFERRED EMBODIMENT

According to the present invention, the externally framed detachable or collapsible baggage is characterized by its structure formed by an external frame which can be readily detached and set up quickly, and a bag enclosure which has external sleeves available on each peripheral edge of the two large opposite faces of the bag enclosure for frame tubes to insert and to hold the bag enclosure in its normal bag-defining formation and which is preferably formed of genuine leather, synthetic leather, cloth or any other suitable sheet material which is flexible or pliable or which can be folded.

Figure 1:
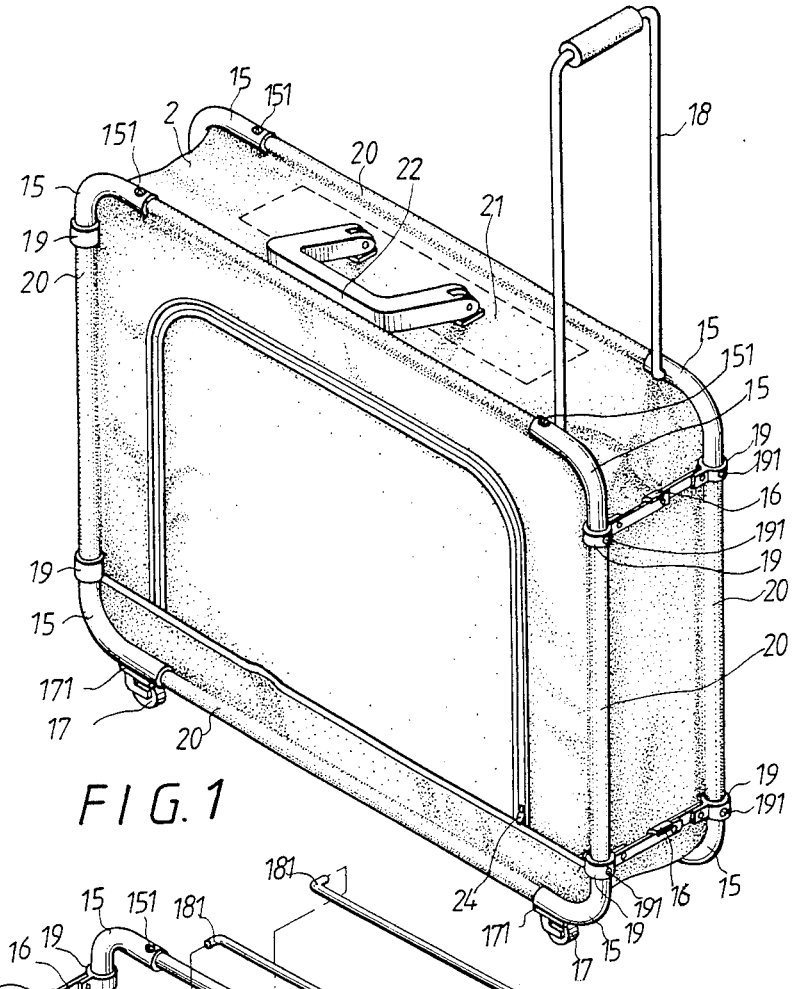
FIG. 1 is a perspective view of a piece of baggage embodying the present invention.
Figure 2:
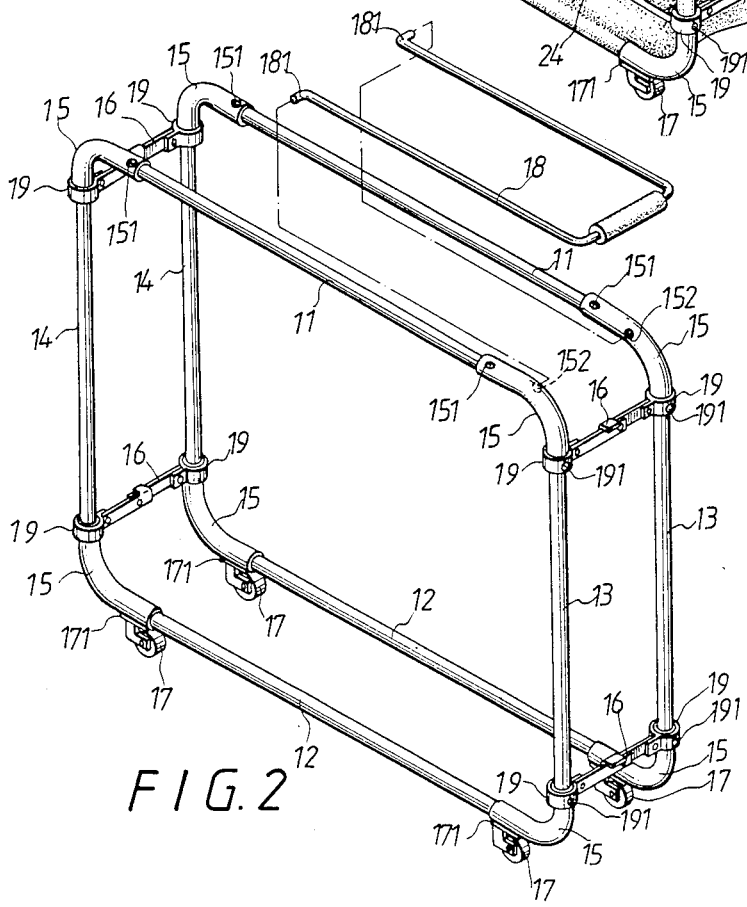
FIG. 2 is a perspective view of the structure of an external frame of the present invention.

Referring to the drawings of FIG. 1 and 2, the piece of baggage embodying the present invention, comprising a frame structure which is preferably formed of one pair of superior or upper transverse tubes 11, one pair of inferior or lower transverse tubes 12, one pair of anterior or front upright tubes 13, one pair of posterior or rear upright tubes 14, and eight pieces of bent tubes 15 to respectively connect the transverse tubes and upright tubes, together with four pieces of foldable cross-bars 16 to connect superiorly and inferiorly or at respective upper and lower points each pair of upright tubes.

Figure 4:
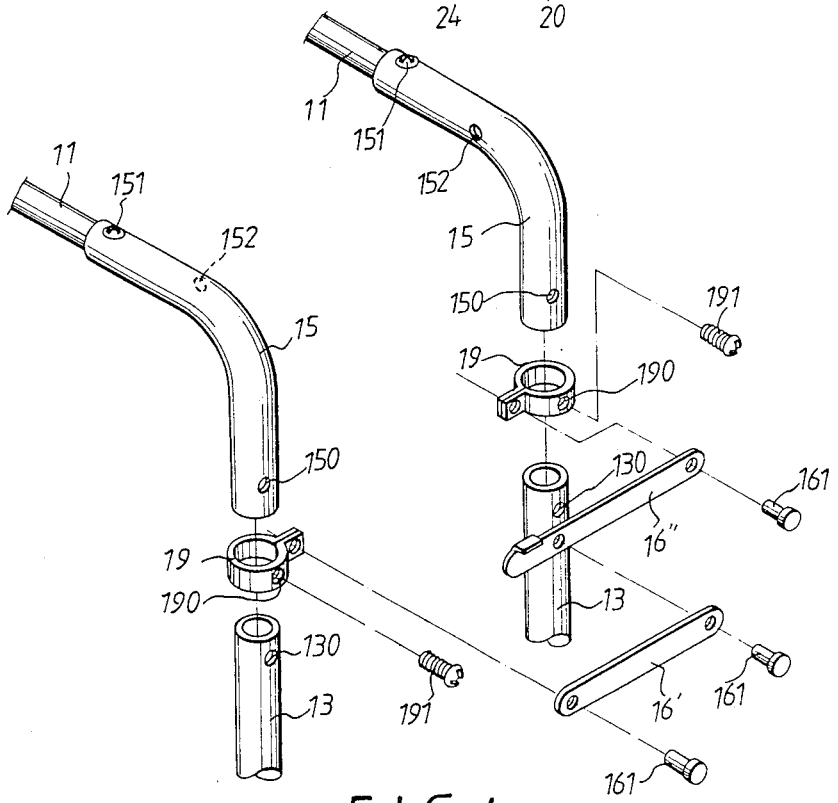
FIG. 4 is a perspective view of part of the external frame in its detached condition.

According to the present invention, transverse tubes and upright tubes are of the same caliber or diameter while the bent tubes 15 are bigger. As shown by the drawing of FIG. 4, transverse tubes, upright tubes and bent tubes are characterized by their respective tap holes 110 (not shown in drawings), 130 and 150 on both ends of each respective tube for screw bolt to secure when one end of transverse tube and one end of upright tube are inserted into one bent tube at each end, wherein one foldable cross-bar which comprises two pieces or cross-arms 16', 16'' fastened by rivet 161 and each of which has ferrules 19 one each fastened by rivet to its both sides, are attached to transverse tubes and bent tubes in such a manner that each ferrule which is biggest in caliber or diameter locks each bent tube where upright tube is stuck into the bent tube and they all are secured by screw bolt 191 through tap hole 190 of the ferrule, tap hole 150 of the bent tube and tap hole 130 of the upright tube.

According to the present invention, as shown in FIGS. 1 and 2, the external frame is characterized by its four rolling wheels 17 with respective wheel sleeves attached, wherein each wheel sleeve is fastened by a screw bolt inferiorly to or underneath each respective bent tube of the two inferior or lower pairs.

In addition to the said feature, the external frame also comprises one extension handle 18 which is characterized by its square bent free end 181 on both ends to stick into respective holes of each bent tube of one superior or upper pair to serve as a trailing handle for carrying the baggage and which can be detached from the bent tubes by squeezing both sides thereof to let the square bent free ends disengage from holes 152.

Figure 3:
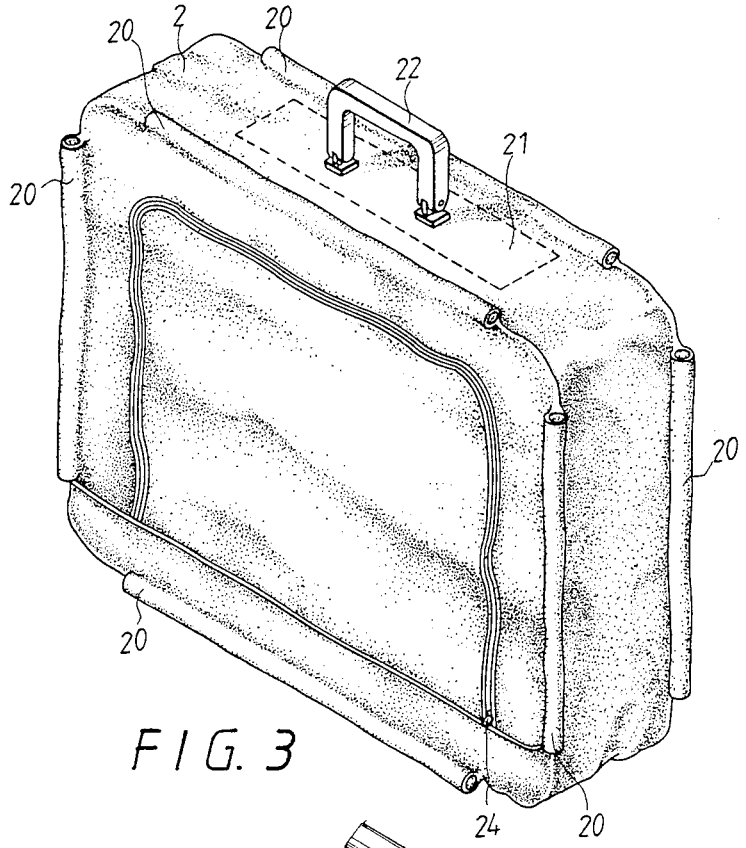
FIG. 3 is a perspective view of the flexible or pliable bag enclosure of the present invention.

The detachable or collapsible baggage embodying the present invention, as shown in FIG. 3, comprises a bag enclosure 2 which is preferably formed of genuine leather, synthetic leather, cloth or any other suitable sheet material which is flexible or pliable or which can be folded. Said bag enclosure which is dimensioned in relation to the exterior of the frame to form a tetragonal formation is characterized by its external sleeves 20 along the four peripheral edges of the two large opposite faces of the bag enclosure for transverse tubes of the superior and inferior pairs and upright tubes of the anterior and posterior pairs to insert so as to set up the frame structure after respective tubes have been fastened thereto.

In addition to the before-mentioned extension handle 18, the bag enclosure 2 is provided with a carrying handle 22 which is pivotally secured to one metal plate 21 enclosed within upper face of the bag enclosure. Said bag enclosure has one rigid pad (not shown in drawings) disposed inside, which pad is seamed together with the bottom face of the bag enclosure at one lateral edge with the opposite lateral edge free to move so that the pad may either cover the bottom face of the bag enclosure to reinforce its rigidity when the bag is set up into operative condition, or be stood upright when the bag is collapsed and not in use.

The front side of the bag enclosure of the present invention is provided with an opening and a releasable closure part along the peripheral of the face which may be closed and opened by a side operated fastener or zipper 24.

Figure 5:
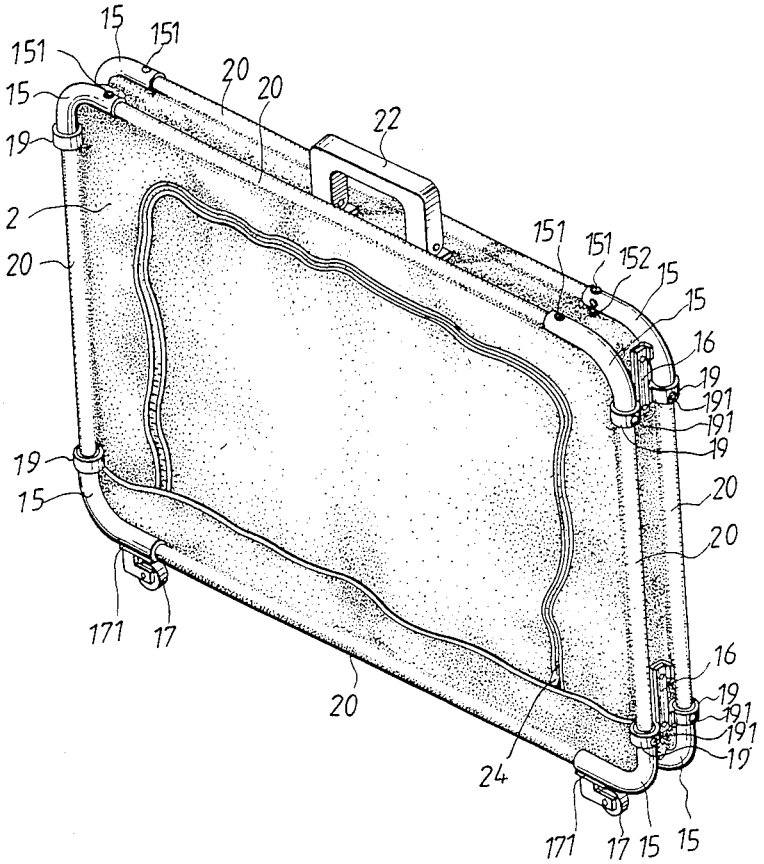
FIG. 5 is a perspective view of the bag in its folded or collapsed condition.

As shown in FIG. 5, the baggage of the present invention is in its collapsed condition by means of collapsing the foldable cross-bar to keep the external frame of each side in contact with each other and to keep the whole embodiment reduced in size for storage or other purposes.

It will be understood, in this condition, as proved in an example of the present invention, when the piece of baggage is detached and collapsed it has a dimension of 0.25 cubic feet approximately; while it is set up into operative condition the dimension will be increased up to 15 cm×60 cm×45 cm. This example indicates that when detached and collapsed, the baggage of the present invention will be reduced in size by seven eigths approximately which will drastically save transporation cost and is indeed worthy of economic effect.

I claim:

1. An externally and detachably framed piece of collapsible baggage comprising:

a flexible bag enclosure for defining a volume therein, said bag enclosure including spaced opposed front and back sides, each said front and back side having upper, lower, left, and right edges, an external sleeve attached along each said edge, each said sleeve having first and second ends, each said sleeve extending less than the length of each said respective edge for defining a sleeveless space between adjacent sleeves; and an external collapsible frame structure supporting said flexible bag structure and defining the volume thereof, said collapsible frame structure including a pair of front and back frames supporting said front and back sides of said bag enclosure, each said front and back frame including four tubes, each tube of said four tubes being removably inserted in a respective external sleeve, each said front and back frame having four bent tubes, each bent tube detachably connecting adjacent ones of said four tubes and being in one of said sleeveless spaces defined between adjacent ends of adjacent sleeves, and collapsible cross-bar means for moving said front and back frames apart for moving said spaced opposed front and back sides of said flexible bag enclosure apart for varying the volume defined by said flexible bag enclosure, said collapsible cross-bar means being detachably attached to each said front and back frames.

2. A device as in claim 1, wherein said cross-bar means includes an upper and lower pair of cross-bars, and each said pair of cross-bars is detachably attached to said front and back frames in one of said sleeveless spaces defined between adjacent ends of adjacent sleeves.

3. A device as in claim 2, further comprising means for detachably attaching a handle to said front and back frames, a handle detachably attached to said attaching means, and a plurality of wheels attached to said front and back frames.

* * * * *